US005127472A

United States Patent [19]

Watson et al.

[11] Patent Number: 5,127,472

[45] Date of Patent: Jul. 7, 1992

[54] INDICATING BALL CATCHER

[75] Inventors: Brock W. Watson, Duncan, Okla.; Joseph S. Squyres; Alfred H. Jones, both of Lafayette, La.; William J. May, Jr., Morgan City, La.; T. Austin Freeman, Wassenaar, Netherlands

[73] Assignee: Halliburton Company, Duncan, Okla.

[21] Appl. No.: 737,073

[22] Filed: Jul. 29, 1991

[51] Int. Cl.[5] ..... E21B 37/02

[52] U.S. Cl. ..... 166/177; 15/3.51; 15/104.062; 166/193

[58] Field of Search ..... 166/117, 153, 155, 156, 166/167, 177, 162, 192, 193, 195, 318; 15/104.061, 104.062, 3.51

[56] References Cited

U.S. PATENT DOCUMENTS

| | | | |
|---|---|---|---|
| 295,926 | 4/1884 | Learned | 210/437 |
| 1,167,670 | 1/1916 | Wheeler | 166/99 |
| 1,190,841 | 7/1916 | Almasy et al. | 210/314 |
| 1,465,320 | 8/1923 | Spruill | 166/99 |
| 1,880,004 | 9/1932 | Worswick | 166/99 |
| 2,411,044 | 11/1946 | Landrum et al. | 166/153 X |
| 2,951,255 | 9/1960 | Ver Nooy | 166/153 X |
| 2,961,045 | 11/1960 | Stogner et al. | 166/75 |
| 2,961,046 | 11/1960 | Moeller et al. | 166/75 |
| 3,171,148 | 3/1965 | Osborn et al. | 15/104.06 |
| 3,319,710 | 5/1967 | Heeren et al. | 15/3.51 X |
| 3,715,055 | 2/1973 | Kendrick et al. | 221/75 |
| 3,895,678 | 7/1975 | Wright et al. | 166/284 |
| 4,102,401 | 7/1978 | Erbstoesser | 166/284 |
| 4,160,482 | 7/1979 | Erbstoesser et al. | 166/284 |
| 4,420,040 | 12/1983 | Arbasak et al. | 166/70 |

FOREIGN PATENT DOCUMENTS 234212 5/1911 Fed. Rep. of Germany .

*Primary Examiner*—David J. Bagnell

*Attorney, Agent, or Firm*—James R. Duzan; Neal R. Kennedy

[57] ABSTRACT

An indicating ball catcher for use in a downhole drill pipe or tool string. The ball catcher comprises an upper body portion having an inlet opening smaller than any ball pumped thereto and a lower body portion. An elongated case interconnects the upper and lower body portions. A bypass is provided for allowing fluid flow around any ball caught in the apparatus and preventing the ball from being pumped therefrom. A reverse bypass may be provided so that fluid back flow is allowed without pumping the balls therefrom. In one embodiment, the apparatus can accommodate balls which have a larger cross-sectional area than an inner cross-sectional area of the case. The apparatus provides pressure indications at the surface when a ball reaches the upper body portion and when the ball enters the case.

20 Claims, 2 Drawing Sheets

INDICATING BALL CATCHER

BACKGROUND OF THE INVENTION

1. Field of the Invention

This invention relates to apparatus for catching balls used in oil and gas wells, and more particularly, to a ball catcher adapted for use in a downhole drill pipe or tool string for catching and holding resilient wiper balls and providing an indication at the surface to determine the location of the balls.

2. Description of the Prior Art

It is well known in the art to use resilient balls, made of materials such as rubber, in well bores and downhole tool strings. Such balls are used to wipe the inner surface of the well bore or tool string as the ball moves downwardly and also to separate fluids. One typical application for these balls is in squeeze cementing jobs.

The balls are generally placed into the well at the surface using ball injector apparatus or released from a plug container. Some ball injector apparatus are disclosed in U.S. Pat. Nos. 2,961,045 to Stogner and 2,961,046 to Moeller et al., both assigned to the assignee of the present invention. Once the balls are released, it is desirable to catch or retrieve them so that they do not interfere with tool operations. One ball catcher used at the surface to catch resilient baffle balls and fracturing balls is disclosed in U.S. Pat. No. 4,420,040 to Arbasak et al., also assigned to the assignee of the present invention.

There is a need for a ball catcher used in a downhole drill pipe or tool string which can catch and hold resilient balls. There is also a need for a ball catcher which can provide an indication to a well operator that the ball has reached and entered the ball catcher, thereby providing the operator with information of the location of specific fluids in the tool string. The present invention meets this need by providing a ball catcher for use in a drill pipe or tool string and which gives surface pressure indications that the ball has reached the ball catcher and has entered it to be held therein for any number of balls to be caught in the operation.

SUMMARY OF THE INVENTION

The indicating ball catcher of the present invention is a downhole ball catching apparatus comprising housing means for attaching to a tool string and for receiving balls pumped through the tool string, inlet means on the housing means through which the balls may be pumped, and a bypass for allowing fluid flow around the balls after the balls enter the housing means. The inlet means preferably has a cross-sectional area less than a cross-sectional area of any of the balls. In a preferred embodiment, the housing means comprises a body means for attaching to the tool string and a case means for receiving the balls pumped through the inlet means.

The body means may comprise an upper body portion attachable to an upper tool string portion and a lower body portion attachable to a lower tool string portion. The case means may be characterized by an elongated case interconnecting the upper and lower body portions.

In the preferred embodiment, the bypass comprises a plurality of spaced fingers in the housing means such that fluid may flow between the fingers when a ball engages an end of the fingers. These fingers may be integrally formed on the lower body portion.

The ball catching apparatus preferably further comprises a reverse bypass for allowing fluid back flow around any balls within the housing means. The configuration of this reverse bypass may vary depending upon the size of the balls.

For balls which have a cross-sectional area less than an inner cross-sectional area of the case means, the reverse bypass is preferably characterized by a plurality of spaced fingers in the housing means such that the fluid may flow between the fingers when a ball engages an end of the fingers. The fingers may be integrally formed on the upper body portion.

For cases where the cross-sectional area of the ball is greater than an inner cross-sectional area of the case means, the reverse bypass is preferably characterized by a tube disposed in the housing means and defining a plurality of holes therethrough such that fluid may flow through the holes when a ball is in the tube. The tube may be attached to the upper body portion.

The tube and housing means define a fluid flow annulus therebetween, and the tube is sized to frictionally hold the ball therein as fluid flows through the holes in the tube in a reverse direction through the ball catching apparatus.

An important object of the present invention is to provide a ball catching apparatus which can provide a surface pressure indication to the operator that the ball has reached the ball catcher and a further indication that it has entered the ball catcher to be retained therein.

Another object of the invention is to provide a ball catching apparatus for use in a drill pipe or tool string for catching balls used to wipe the inner surface of the tool string as in cementing jobs.

An additional object of the invention is to provide a ball catcher which allows reverse fluid flow thereto without pumping the balls back up the tool string.

A further object of the invention is to provide a ball catching apparatus which allows fluid flow and reverse fluid flow therethrough regardless of the size of the ball.

Additional objects and advantages of the invention will become apparent as the following detailed description of the preferred embodiments is read in conjunction with the drawings which illustrate such embodiments.

DESCRIPTION OF THE PREFERRED EMBODIMENTS

First Embodiment

Figure 1A:
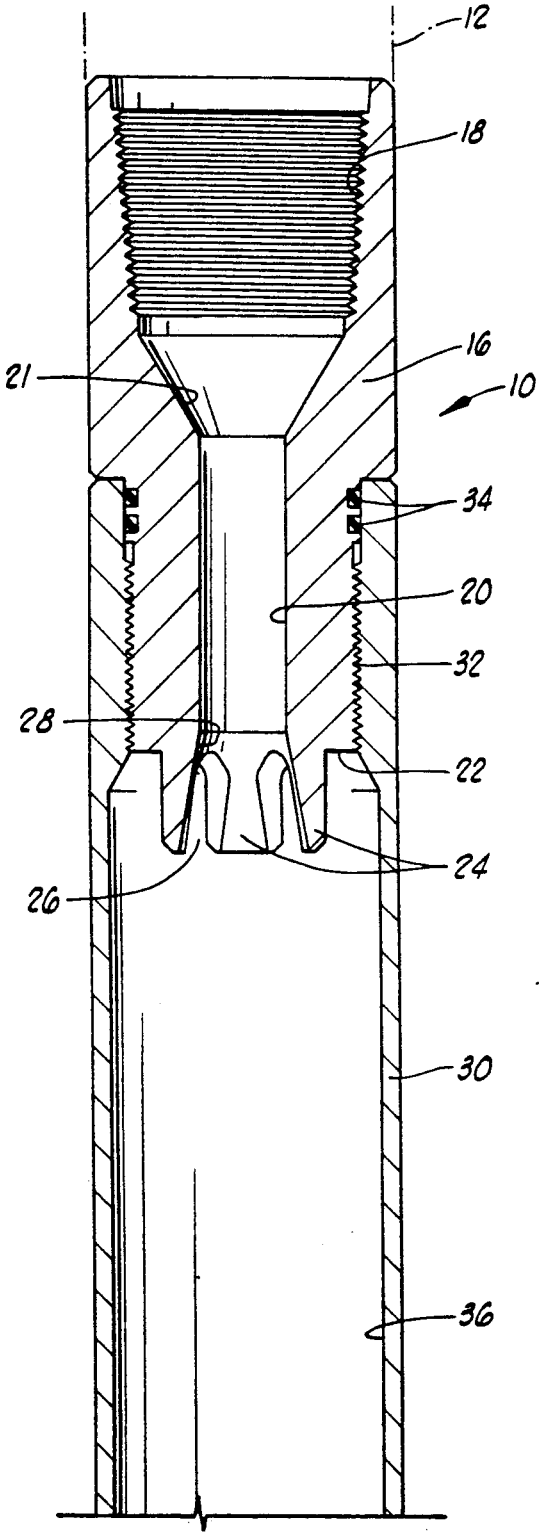
FIGS. 1A and 1B illustrate a first embodiment of the indicating ball catcher of the present invention.
Figure 1B:
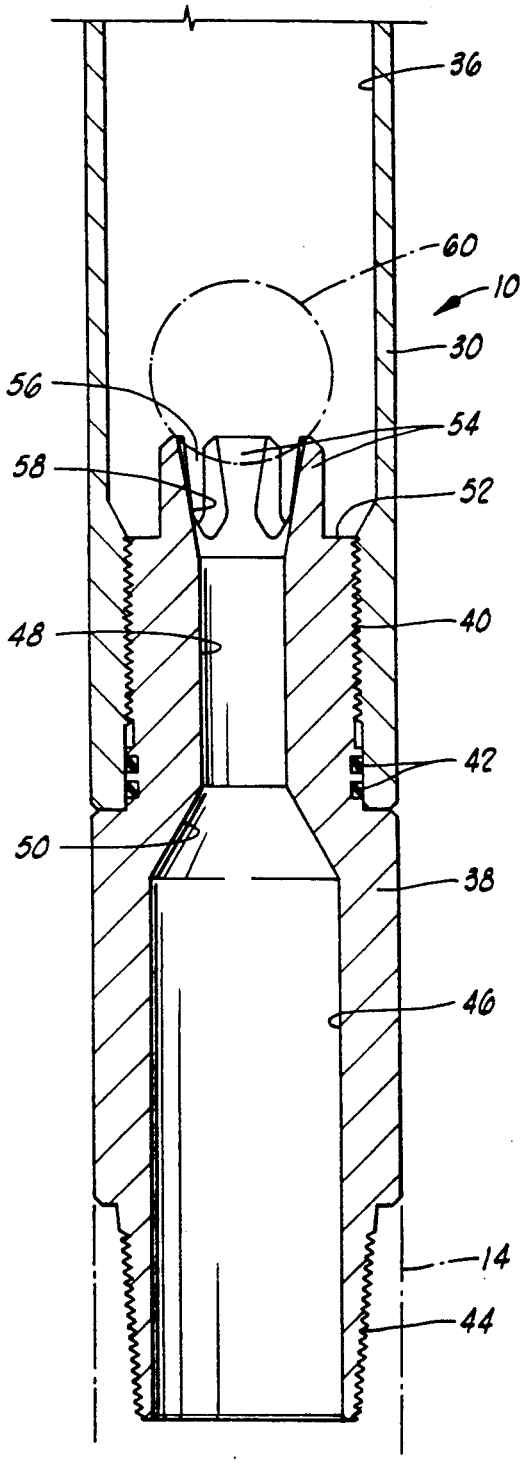

Referring now to the drawings, and more particularly to FIGS. 1A and 1B, a first embodiment of the indicating ball catcher of the present invention is shown and generally designated by the numeral 10. Ball catcher 10 is adapted for positioning in a drill pipe string or tool string between an upper drill pipe or tool string portion 12 and a lower drill pipe or tool string portion 14.

Ball catcher 10 generally comprises a housing means for positioning in the tool string, and the housing means comprises a body means for connecting to upper and lower tool string portions 12 and 14 and a case means for receiving balls therein which will be further described in more detail. The balls are made of a resilient material such as rubber.

The body means may be characterized at least in part by an upper body 16 having a threaded inner surface 18 adapted for engagement with upper tool string portion 12. Upper body 16 has a bore 20 therein which is designed to be smaller than the outside diameter of the resilient balls pumped through the tool string to ball catcher 10. That is, the cross-sectional area of bore 20 is less than a normal or free cross-sectional area of any of the balls. Above bore 20 is a tapered inner surface 21.

Upper body 16 has a downwardly facing end 22, and extending downwardly from this end are a plurality of fingers 24. Preferably, fingers 24 are integrally formed on upper body 16 and define a plurality of notches 26 therebetween which are angularly spaced about a central axis of ball catcher 10. A tapered bore 28 in the bottom of upper body 16 will be seen to form a tapered inner surface of each finger 24.

The case means is preferably characterized by an elongated case 30 attached to upper body 16 at threaded connection 32. A sealing means, such as a pair of O-rings 34, provides sealing engagement between upper body 16 and case 30.

Case 30 has a bore 36 therethrough. Bore 36 is sized to be larger than the outside diameter of any balls that will be pumped into first embodiment ball catcher 10.

Referring now to FIG. 1B, the lower end of case 30 is attached to a lower body 38 at threaded connection 40. Lower body 38 characterizes at least a portion of the body means. A sealing means, such as a pair of O-rings 42, provides sealing engagement between case 30 and lower body 38.

At the lower end of lower body 38 is an externally threaded surface 44 which is adapted for engagement with lower tool string portion 14.

Lower body 38 has a first bore 46 therein and a smaller second bore 48. A tapered surface 50 interconnects first bore 46 and second bore 48. Second bore 48 is sized to be smaller than the outside diameter of any balls pumped to ball catcher 10. In the embodiment shown, second bore 48 in lower body 38 is substantially the same size as bore 20 in upper body 16, but this is not necessary.

Lower body 38 has an upwardly facing end 52 with a plurality of upwardly extending fingers 54 thereon. Fingers 54 are angularly spaced about the central axis of ball catcher 10. Preferably, fingers 54 are integrally formed on lower body 38 and define notches 56 therebetween. Lower body 38 defines a tapered bore 58 therein which thus forms a tapered inner surface on each of fingers 54.

In the preferred embodiment, fingers 54 on lower body 38 are substantially identical to fingers 24 on upper body 16.

Operation of the First Embodiment

When desirable in a well operation, a resilient ball is pumped down the tool string. For example, the ball can be used to wipe cement or other materials in a squeeze cementing job. In another example, various fluids and materials can be separated and the drill pipe cleaned as in a well stimulation job. Ball catcher 10 is usually located in the tool string immediately above other tools so that the balls cannot interfere with those tools. The resilient balls are released from a ball injector or plug container at the surface, and the balls wipe the drill pipe and separate fluids and then enter ball catcher 10 through upper body 16.

In ball catcher 10, the ball first engages tapered surface 21, thus sealing off bore 20 in upper body 16 because the ball is larger than the bore. This engagement is indicated at the surface by an increase in pressure necessary to force the ball through bore 20. Because the ball is made of a resilient material such as rubber, it is deformed sufficiently to pass through bore 20 and enter case 30. Thus, bore 20 in upper body 16 characterizes an embodiment of an inlet means through which the balls may be pumped.

As soon as the ball is discharged from bore 20 in upper body 16, an indication is provided at the surface because the pressure will immediately drop. Thus, the operator knows when the ball reaches ball catcher 10 and also when it has moved into case 30 of the ball catcher.

The ball will fall or be moved downwardly through case 30 until it engages upwardly extending fingers on lower body 38. Such a ball is indicated by the reference numeral 60 in FIG. 1B. Fluid will flow around ball 60 and downwardly through lower body 38 of ball catcher 10 because of notches 56 between fingers 54. Notches 56 are sized such that there is substantially no differential pressure created by fluid flowing around ball 60 so that the ball will not be forced downwardly through lower body 38 and out of ball catcher 10. Thus, a bypass is provided for allowing fluid flow around ball 60, and ball 60 is retained in ball catcher 10 once it enters therein.

If there is a need for reverse flow through ball catcher 10, ball 60 will be pumped back up toward upper body 16 until it engages fingers 24. Similar to the downward flow previously described, fluid is free to flow around the ball through notches 26 without pumping the ball upwardly through upper body 16. Notches 26 are sized similar or equal to notches 56. Thus, a reverse bypass is provided for allowing fluid back flow around ball 60, and the ball is held in ball catcher 10 even when there is reverse flow.

It should be apparent that as each ball of a plurality of balls are retained in the ball catcher 10 a positive pressure indication can be observed.

Second Embodiment

Figure 2A:
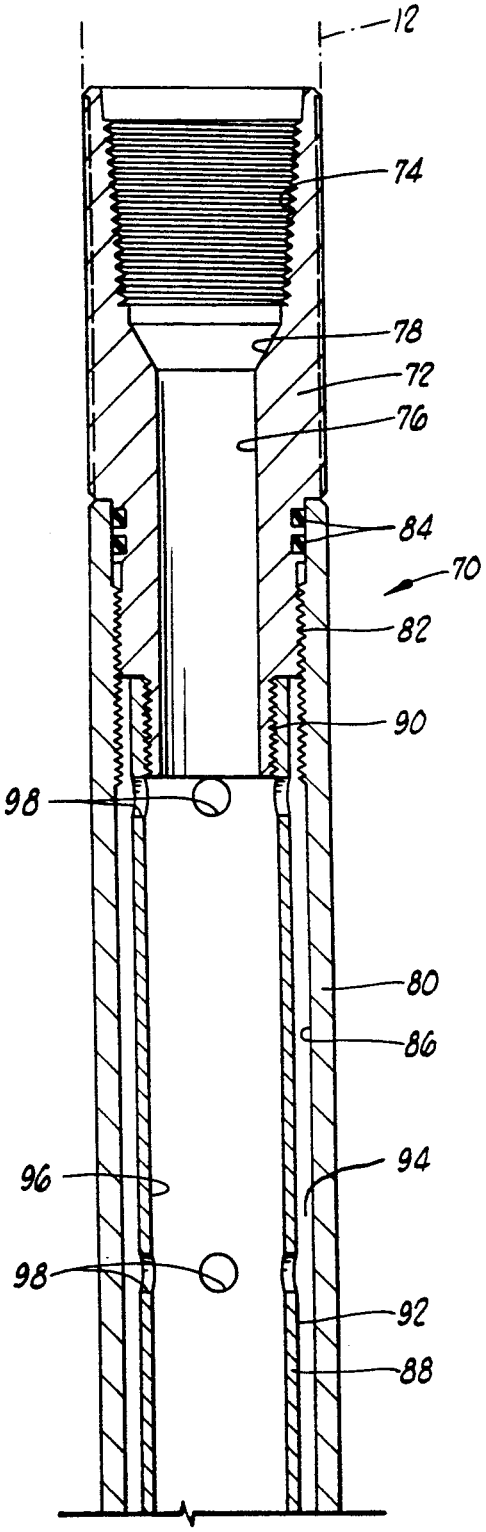
FIGS. 2A and 2B show a second embodiment of the ball catcher.
Figure 2B:
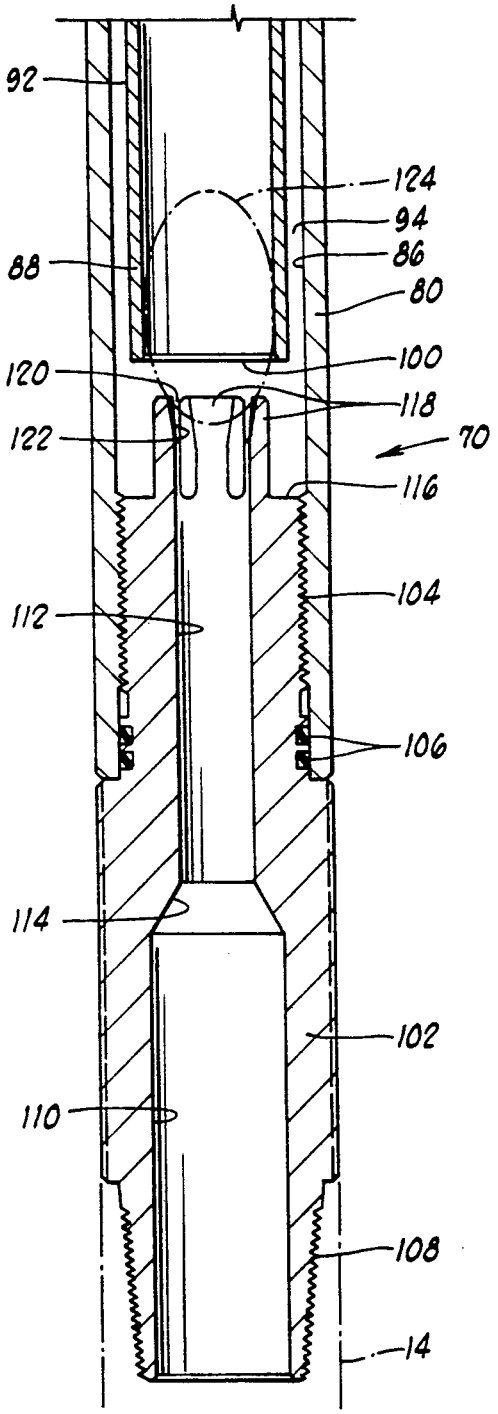

Referring now to FIGS. 2A and 2B, a second embodiment of the ball catcher of the present invention is shown and generally designated by the numeral 70. As with first embodiment 10, second embodiment 70 is adapted for positioning in a tool string and has housing means for connecting to upper tool string portion 12 and lower tool string portion 14. Again, the housing means comprises body means for connecting to the tool string and case means for receiving the balls pumped thereto.

The body means in second embodiment 70 preferably comprises an upper body 72 having an internally threaded surface 74 adapted for connection to upper tool string portion 12. Upper body 72 defines a bore 76 therethrough which is sized to be smaller than the outside diameter of any balls pumped to ball catcher 70. That is, bore 76 has a cross-sectional area less than a normal cross-sectional area of any balls pumped thereto. Above bore 76 is a tapered surface 78.

The case means preferably comprises an elongated case 80 attached to upper body 72 at threaded connection 82. A sealing means, such as a pair of O-rings 84, provide sealing engagement between upper body 72 and case 80. Case 80 defines a bore 86 therein.

Extending downwardly from upper body 72 is an elongated tube 88 which is attached to the upper body at threaded connection 90. Tube 88 has an outer surface 92 which is spaced inwardly from bore 86 in case 80 such that an annulus 94 is defined between tube 88 and case 80.

Tube 88 has a bore 96 therethrough which preferably has a diameter less than the outside diameter of any ball pumped to ball catcher 70. That is, bore 96 has a cross-sectional area less than that of any of the balls. In the embodiment illustrated, bore 96 in tube 88 is slightly larger than bore 76 in upper body 72, but this is not necessarily a requirement.

A plurality of holes 98 are defined in an upper portion of tube 88 and provide communication between bore 96 and annulus 94. In the illustrated embodiment, holes 98 are spaced angularly about the central axis of ball catcher 70 and also spaced longitudinally along the length of tube 88. However, the invention is not intended to be limited to any particular hole alignment or spacing configuration.

Tube 88 has a downwardly facing lower end 100.

The body means also preferably comprises a lower body 102 which is attached to the lower end of case 80 at threaded connection 104. A sealing means, such as a plurality of O-rings 106, provides sealing engagement between case 80 and lower body 102.

Lower body 102 is substantially similar to lower body 38 in first embodiment ball catcher 10. At the lower end of lower body 102 is an externally threaded surface 108 adapted for engagement with lower tool string portion 14.

Lower body 102 defines a first bore 110 therein and a smaller second bore 112. A tapered surface 114 extends between first bore 110 and second bore 112. Second bore 112 is sized to be smaller than the outside diameter of any ball pumped to ball catcher 70.

Lower body 102 has an upwardly facing end 116 from which extends a plurality of fingers 118. As with fingers 54 in first embodiment ball catcher 10, fingers 118 define a plurality of notches 120 therebetween since fingers 118 are angularly spaced around the central axis of ball catcher 70. Fingers 118 are preferably integrally formed on lower body 102, and the lower body defines a tapered bore 122 which thus provides a tapered inner surface for at least a portion of the length of fingers 118. The upper ends of fingers 118 are spaced below lower end 100 of tube 88.

Operation of the Second Embodiment

Second embodiment ball catcher 70 is used in a manner substantially similar to that of first embodiment ball catcher 10. However, second embodiment ball catcher 70 is designed for use with balls which have a diameter greater than bore 86 in case 80.

As a ball is pumped into ball catcher 70, it is squeezed as it passes by tapered surface 78 in upper body 72 so that it can be forced through bore 76. When this occurs, a surface pressure indication is provided because the pressure required to pump the ball through bore 76 is relatively high. The ball is forced through bore 76 and into bore 96 in tube 88. Thus, bore 76 in upper body 72 characterizes another embodiment of an inlet means through which the balls may be pumped.

As the ball passes downwardly past holes 98, fluid flows through holes 98 into annulus 94, thus resulting in a pressure reduction which is also indicated at the surface. In this way, the operator knows when the ball reaches ball catcher 70 and also when it has passed into tube 88.

Since the outside diameter of the ball is greater than the diameter of bore 86 in case 80, tube 88 is provided so that the ball will not sealingly close off fluid flow through case 80. When a ball reaches its downwardmost position, as indicated by ball 124 in FIG. 2B, it will be deformed within tube 88. A lower portion of ball 124 may extend out of lower end 100 of tube 88 until it engages fingers 118. Those skilled in the art will see that a complete fluid flow path is provided from bore 76 in upper body 72, through holes 98, annulus 94 and notches 120 into second bore 112 of lower body 102. As with the first embodiment, notches 120 prevent a pressure differential building up across ball 124 so that it will not be pumped downwardly out of ball catcher 70. Thus, a bypass is provided for allowing fluid flow around ball 124.

Reverse flow is also provided through ball catcher 70. Fluid may be pumped upwardly through notches 120 into annulus 94 and through holes 98 in tube 88 to flow into bore 76 in upper body 72. Because ball 124 is deformed, it is frictionally held within bore 96 in tube 88 sufficiently so that fluid flow does not force it upwardly. That is, the flow path described does not allow a sufficient differential pressure across ball 124 during fluid back flow to move it upwardly, and a reverse bypass is provided.

Second embodiment ball catcher 70 thus provides a ball catching apparatus which includes all of the advantages of first embodiment ball catcher 10 and additionally allows for the use of relatively large balls. Again, it should be apparent that as each ball of a plurality of balls are retained in the ball catcher to a positive pressure indication can be observed.

It will be seen, therefore, that the indicating ball catcher of the present invention is well adapted to carry out the ends and advantages mentioned, as well as those inherent therein. While two preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A downhole ball catching apparatus comprising:

housing means for attaching to a tool string and for receiving balls pumped through said tool string;

inlet means on said housing means through which said balls may be pumped, said inlet means having a cross-sectional area less than a cross-sectional area of any of said balls; and a bypass for allowing fluid flow around said balls after said balls enter said housing means.

2. The apparatus of claim 1 wherein said housing means comprises:

body means for attaching to said tool string; and case means for receiving balls pumped through said inlet means.

3. The apparatus of claim 2 wherein:

said body means comprises:

an upper body attachable to an upper tool string portion; and a lower body attachable to a lower tool string portion; and said case means is characterized by an elongated case interconnecting said upper body and said lower body.

4. The apparatus of claim 1 wherein said bypass is characterized by a plurality of spaced fingers in said housing means such that fluid may flow between said fingers when a ball engages an end of said fingers.

5. The apparatus of claim further comprising a reverse bypass for allowing fluid back flow around a ball within said housing means.

6. The apparatus of claim 5 wherein said reverse bypass is characterized by a plurality of spaced fingers in said housing means such that fluid may flow between said fingers when a ball engages an end of said fingers.

7. The apparatus of claim 5 wherein said reverse bypass is characterized by a tube disposed in said housing means and defining a plurality of holes therethrough such that fluid may flow through said holes when a ball is in said tube.

8. The apparatus of claim 7 wherein said tube and said housing means define a fluid flow annulus therebetween.

9. The apparatus of claim 7 wherein said tube is sized to frictionally hold said ball therein.

10. A ball catcher for use in catching and holding resilient balls pumped through a tool string, said ball catcher comprising:

an elongated case having a bore therein;

an upper body portion attached to an upper end of said case and having an opening therein with a cross-sectional area less than a normal cross-sectional area of any of the balls pumped thereto;

a lower body portion attached to a lower end of said case and having an opening therein with a cross-sectional area less than an outside diameter of any of said balls; and a bypass for allowing fluid flow from said upper body opening to said lower body opening and around any ball disposed in said case for preventing any ball from being pumped out of said case.

11. The apparatus of claim 10 wherein said bypass is characterized by a plurality of fingers extending from said lower body portion such that fluid may flow between said fingers and into said lower body opening.

12. The apparatus of claim 11 wherein said fingers are integrally formed on said lower body portion.

13. The apparatus of claim 11 wherein said fingers have a tapered inner surface therein.

14. The apparatus of claim 10 further comprising a reverse bypass for allowing fluid flow from said lower body opening to said upper body opening and around any ball disposed in said case.

15. The apparatus of claim 14 wherein said reverse bypass comprises a plurality of fingers extending downwardly from said upper body portion.

16. The apparatus of claim 15 wherein said fingers are integrally formed on said upper body portion.

17. The apparatus of claim 14 wherein said reverse bypass comprises a tube extending from said upper body portion, said tube defining a plurality of holes therethrough.

18. The apparatus of claim 17 wherein said tube has an inner cross-sectional area less than a normal cross-sectional area of any of said balls, such that said balls are frictionally held by said tube as fluid flows through said holes in a reverse direction.

19. The apparatus of claim 17 wherein said tube and said bore in said case define a flow annulus therebetween.

20. The apparatus of claim 17 wherein a lower end of said tube is spaced from the first-mentioned bypass.

* * * * *